US007061441B2

(12) United States Patent
Schadler

(10) Patent No.: US 7,061,441 B2
(45) Date of Patent: Jun. 13, 2006

(54) STRIPLINE FED STUB-LOOP DOUBLET ANTENNA SYSTEM AND METHOD

(75) Inventor: John L. Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/848,010

(22) Filed: May 19, 2004

(65) Prior Publication Data

US 2005/0259018 A1 Nov. 24, 2005

(51) Int. Cl.
*H01Q 11/12* (2006.01)

(52) U.S. Cl. ..... 343/742; 343/732; 343/868; 343/874

(58) Field of Classification Search ..... 343/731, 343/732, 737, 741–743, 866, 867, 868, 870, 343/874
See application file for complete search history.

(56) References Cited

U.S. PATENT DOCUMENTS 2,190,816 A * 2/1940 Wheeler ..... 343/742
2,622,196 A * 12/1952 Alford ..... 343/742
3,576,567 A * 4/1971 Shively ..... 343/704
4,160,978 A * 7/1979 DuHamel ..... 343/742
6,020,857 A * 2/2000 Podger ..... 343/742

OTHER PUBLICATIONS

Dielectric Product Bulletin, "Economical FM Broadcast Antennas For Low Power Systems, Type DCR-L Series," pp. 1-2.
JLST, "Circularly Polarized Translator/Booster Antenna," p. 1.
Shively Labs, "Model 6812B Circularly-Polarized FM Antenna," p. 1.
NiCom, "Narrow band FM Circular Polarized Antenna" p. 1.
Ecreso, "Circular Polarization Antennas Datasheet," p. 1.

* cited by examiner

*Primary Examiner*—Shih-Chao Chen
(74) *Attorney, Agent, or Firm*—Baker & Hostetler LLP

(57) ABSTRACT

A stub-loop based antenna doublet array having an offset feed and adjustably positioned stub-loops is provided that enables improved isolation of the horizontal versus vertical polarization characteristics from the impedance. Consequently, conventional VSWR adjustments or tuning can be accomplished without significantly impacting the polarization ratios or pattern.

21 Claims, 6 Drawing Sheets

STRIPLINE FED STUB-LOOP DOUBLET ANTENNA SYSTEM AND METHOD

FIELD OF THE INVENTION

The present invention relates generally to circularly-polarized antennas. More particularly, the present invention relates to circularly-polarized stub-loop antenna systems and methods having adjustable polarization and impedance characteristics.

BACKGROUND OF THE INVENTION

Circularly-polarized antennas are well known in the antenna community as having forms ranging from cross-dipoles, helixes, and crossed slotted cylinders, for example. A particularly elegant circularly-polarized antenna is the stub-loop antenna which consists of a metal wire formed in the shape of a horizontal ring, with vertically opposing dipole arms at the end of the ring. The characteristics of the stub-loop antenna are primarily a function of the feed strap position on the horizontal ring and dipole stub length, wherein the VSWR and the horizontal versus vertical polarization ratio of the antenna are both affected by manipulation of either of these two parameters. Consequently, tuning of a conventional stub-loop antenna unavoidably results in a tradeoff between the desired VSWR response and the desired Horizontal Vertical (H/V) polarization ratio.

Due to this difficulty, conventional stub-loop antennas are not well suited to accommodating the FCC's equal H/V ratio rule. Furthermore, conventional stub-loop antennas have the added problem of having an inherently high downward radiation pattern. The conventional approach to remedy this latter effect have involved the implementation of reduced spaced arrays, such as, half wave spacing between adjacent stub-loop antennas. Obviously, this results in requiring nearly twice the number of stub-loop antennas as in a full wave spaced array to obtain the same respective gain, and additional feed lines and connections for the added stub-loop antennas when fed in a branch-feed configuration. All of these factors have plagued conventional stub-loop antenna systems and have accordingly rendered them less than ideal as a circularly polarized antenna for use in FCC applications.

Therefore, there has been a long-standing need in the community for systems and methods that are FCC compliant and also enable a stub-loop antenna's VSWR to be adjusted without significantly impacting the polarization ratio or vice versus.

SUMMARY OF THE INVENTION

The foregoing needs are met, to a great extent, by the present invention, wherein an apparatus and method is provided that in some embodiments enable tuning of a stub-loop style antenna system to have a near optimal VSWR and polarization ratio.

In accordance with one aspect of the present invention, a circularly polarized antenna array comprises a feed assembly having an outer conductor partially encompassing an inner conductor wherein the outer conductor and the inner conductor are substantially parallel, feedlines coupled to and substantially parallel to the inner conductor and the outer conductor and traversing a substantial portion of a length of the feed assembly, a plurality of stub-loop antennas coaxially disposed about the feed assembly, coupled to the feed lines and positioned approximately one-half wavelength from a neighboring stub-loop antenna, and a feed point for the feed assembly, positioned approximately one-quarter wavelength from a midpoint of the feed assembly and approximately coincident to a first stub-loop antenna, wherein a first pair of the plurality of the stub-loop antennas are fed in opposite phase with respect to a second pair of the plurality of stub-loop antennas.

In accordance with another aspect of the present invention, a circularly polarized antenna array comprises a plurality of radiating means for radiating vertically polarized electromagnetic radiation and horizontally polarized electromagnetic radiation, feeding means for feeding energy to the radiating means, transmission line means for transmitting energy to the feeding means, and means for coupling the transmission line means to the feeding means, wherein the coupling means is positioned approximately one-quarter wavelength from a mid-point of the transmission line means, wherein a first pair of the plurality of radiating means are fed in opposite phase with respect to a second pair of the plurality of radiating means.

In accordance with yet another aspect of the present invention, a method for generating circularly polarized electromagnetic signals, comprises the steps of positioning a first pair of circularly polarized antennas and a second pair of circularly polarized antennas approximately one wavelength from pair center, wherein a first antenna of a pair is approximately one quarter wavelength from a second antenna of the pair, feeding a broadcast signal to the first and second pairs of antennas using oppositely-phased feed points and a feed line directly coupled to the pairs of antennas, and inputting the broadcast signal to a transmission line coupled to the feed line at a point coincident to an antenna and approximately one-quarter wavelength from a mid-point of the transmission line.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE DRAWINGS

Figure 1:
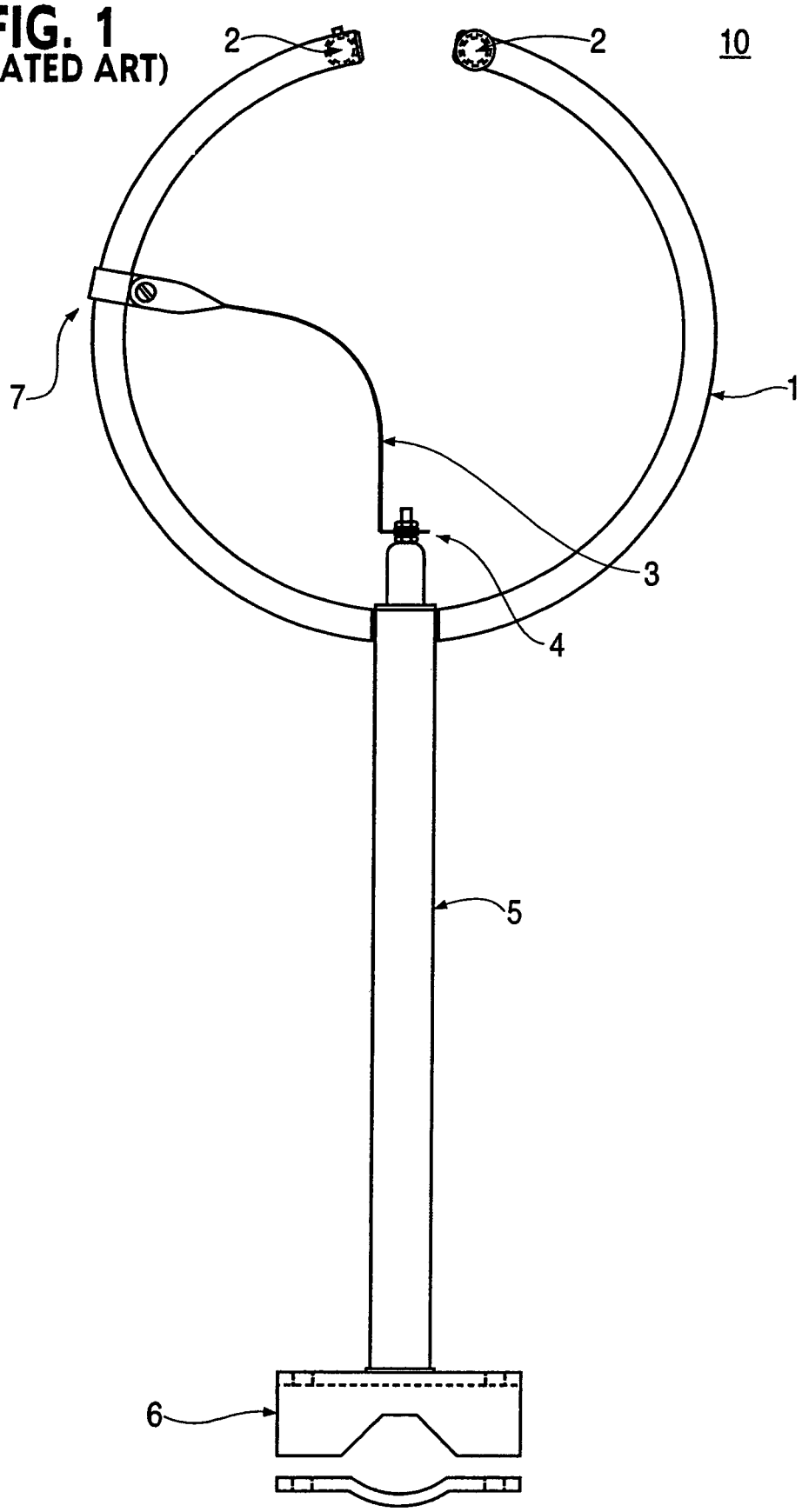
FIG. 1 (RELATED ART)
FIG. 1 is a top view of a conventional stub-loop antenna.

The invention provides an apparatus and method where in some embodiments enable tuning of a stub-loop style antenna system to have a near optimal VSWR and polarization ratio. Preferred embodiments of the invention will now be described with reference to the drawing figures, in which like reference numerals refer to like parts throughout.

Conventional stub-loop antennas are known to have only two basic tuning variables available after the antennas have been manufactured—the feed strap position or the dipole stub length. The adjustment of either of these variables corporately affects both the VSWR and the H/V polarization ratio. Since the FCC requires that FM antennas must have a vertical polarization with an effective radiated power (ERP) less than or equal to the horizontal polarization's ERP, conventional stub-loop antennas must have the feed strap and the dipole stub length adjusted to obtain the H/V ratio of 1. However, once set, the antenna's impedance can no longer be adjusted since the polarization ratio will be adversely affected. Consequently, when a H/V ratio of 1 is obtained and a less than desirable impedance results, adjustments to the impedance are trepidly performed.

Figure 2:
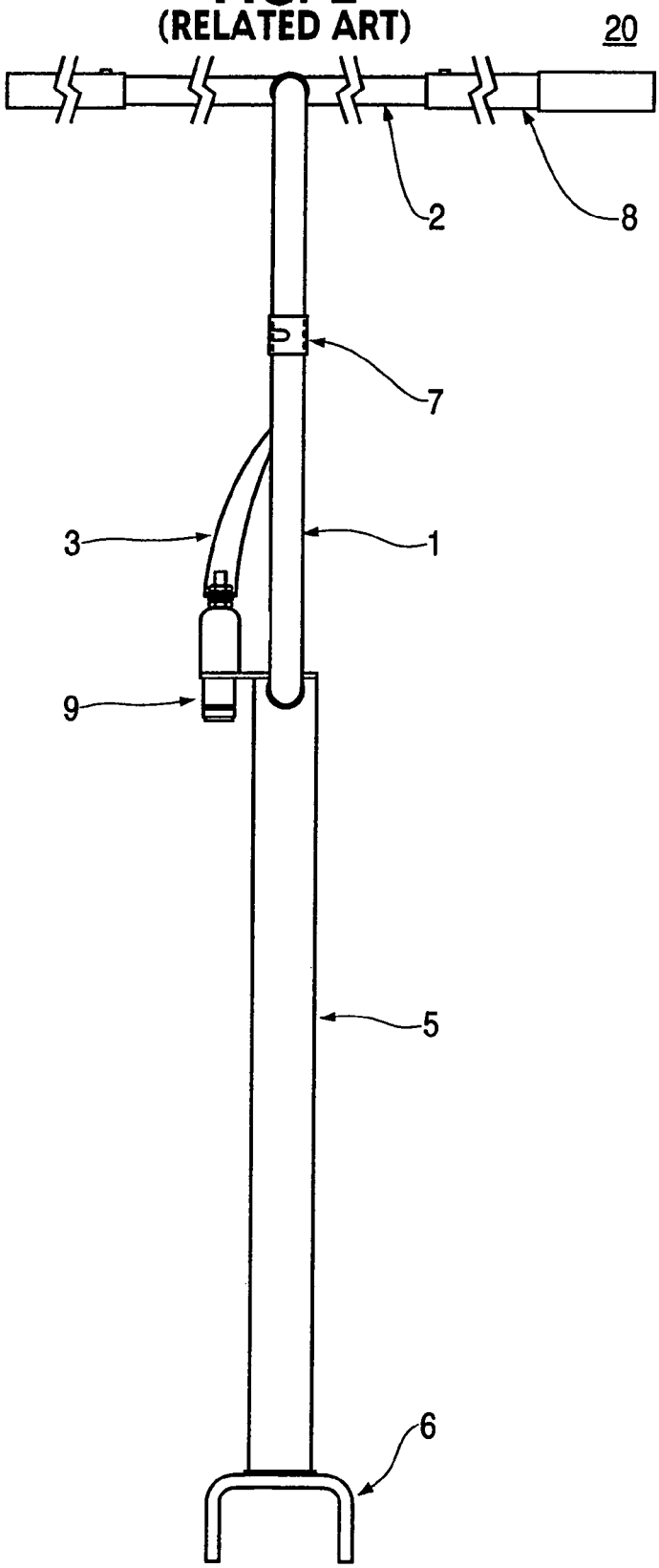
FIG. 2 (RELATED ART)
FIG. 2 is a side view of the conventional stub-loop antenna of FIG. 1.

In order to better understand the various aspects of the embodiments disclosed herein, a description of conventional stub-loop antennas as shown in FIGS. 1–2 is provided. FIG. 1 is an illustration of a top view of a conventional stub-loop antenna 10. The antenna 10 contains an electrically short loop 1 that radiates in a horizontal polarization. Vertical dipole stubs 2 of opposite orientation are affixed to the open ends of the loop 1 to provide vertically polarized radiation. A feed strap 3, connected to the feed line's inner conductor 4, is attached to the loop 1 via a feed strap location adjusting clamps 7. The antenna 10 is attached to a supporting arm 5 which is, in turn, attached to a mounting assembly 6, which mounts the antenna 10 to a tower or a mast (not shown).

FIG. 2 illustrates a side view 20 of the conventional stub-loop antenna of FIG. 1. FIG. 2 better illustrates the vertical characteristics of the stub-loop antenna 10, particularly the vertical stub-length adjusting tubes 8 which are shown attached to the ends of the vertical dipole stubs 2. It is well known that the input impedance of the antenna 10 is a function of a plethora of variables including the loop 1 diameter, length and physical orientation of the vertical dipoles 2 with respect to the loop 1, desired operating frequency, conductivity of the antenna structure, and location of the feed strap contact/location 7 on the loop 1. For a given design, many of the above-listed factors are fixed with the exception of the feed strap location 7.

In operation, a time-harmonic electrical signal is induced on the horizontal loop 1 via the feed strap 3 attachment 7 which is placed at an appropriate section of the loop 1. Depending on the position of the feed strap location 7 on the loop 1, the induced current will be apportioned between the horizontal loop 1 and the vertical dipoles 2. Based on this positioning, the H/V polarization ratio can be adjusted. However, as mentioned above, the input impedance or, alternatively, the VSWR of the antenna will be affected for different positionings of the feed strap 7. Concomitant with this is the fact that an optimally VSWR-tuned stub-loop antenna will often have a mismatched H/V polarization ratio. Accordingly, tuning of stub-loop antenna designs have involved tedious trial and error procedures and therefore are not known as being not well suited to convenient VSWR versus H/V polarization ratio tuning.

Many of the above problems of the prior art are obviated by the systems and methods of the present invention. In particular, by devising, for example, an alternate feed mechanism and appropriately phasing neighboring stub-loop antennas, decoupling of the VSWR and polarization tuning process can be accomplished.

Figure 3:
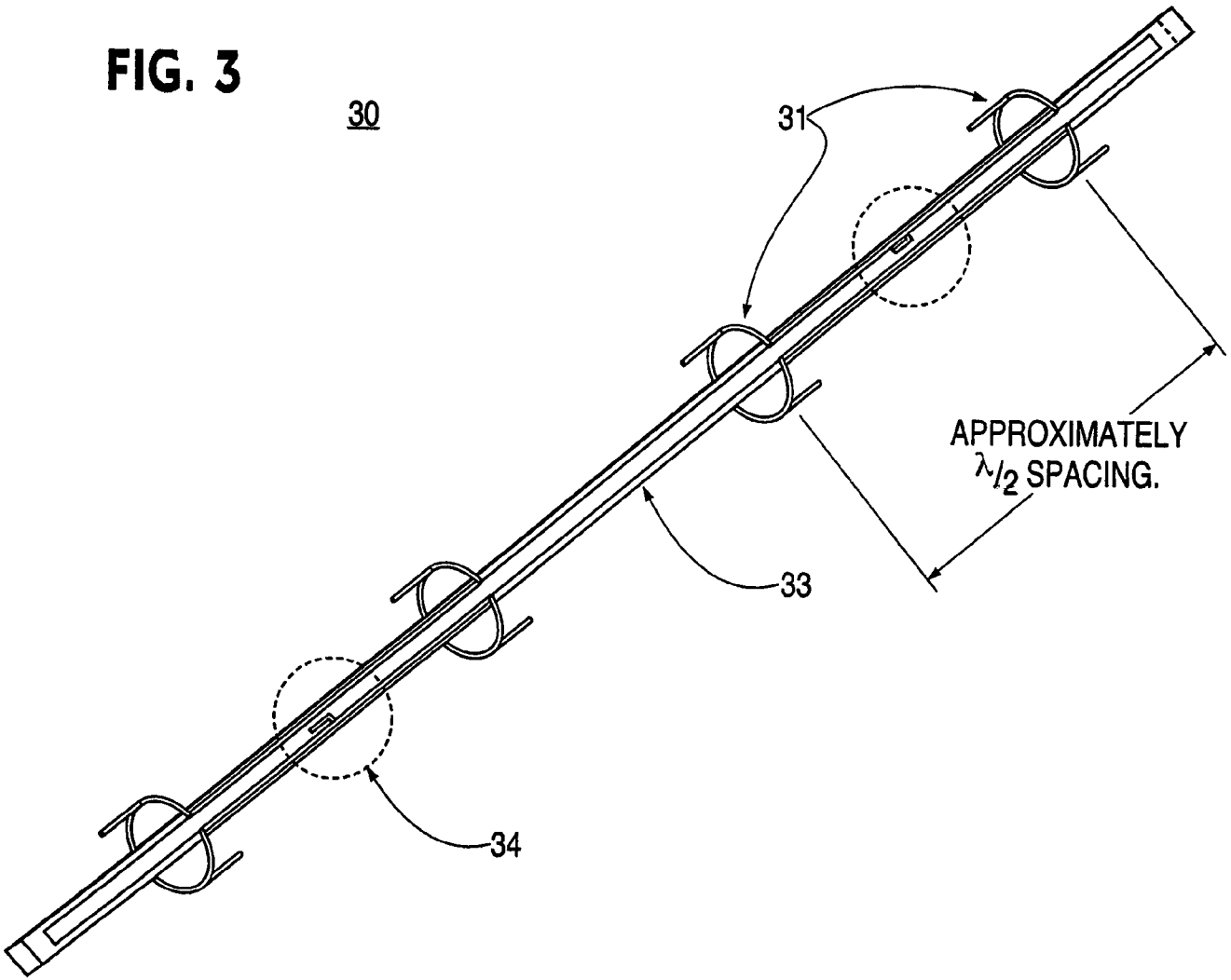
FIG. 3 is a perspective view of an exemplary stub-loop antenna according to a preferred embodiment of the invention.

FIG. 3 illustrates a perspective view of an exemplary stub-loop antenna doublet system 30 according to this invention. The exemplary antenna doublet system 30 comprises an assembly of approximately ½ wavelength spaced pairs of stub-loop antennas 31 positioned over a fixed length stripline 33. Each antenna 31 of the "upper" and "lower" pairs of stub-loop antennas 31 are fed via a twin line feed 34 coupled to the stripline's 33 inner conductor and to the stripline's 33 outer conductor. The twin line feed 34 is coupled to the stripline 33 at a near midpoint of a doublet pair of the stub-loop antennas 31 to provide near equal energy distribution to the lower and upper stub-loop antenna 31 of a doublet pair. Each stub-loop antenna 31 of the exemplary antenna doublet system 30 is similarly oriented as its neighboring stub-loop antenna 31 to provide a uniform arraying effect.

Figure 4:
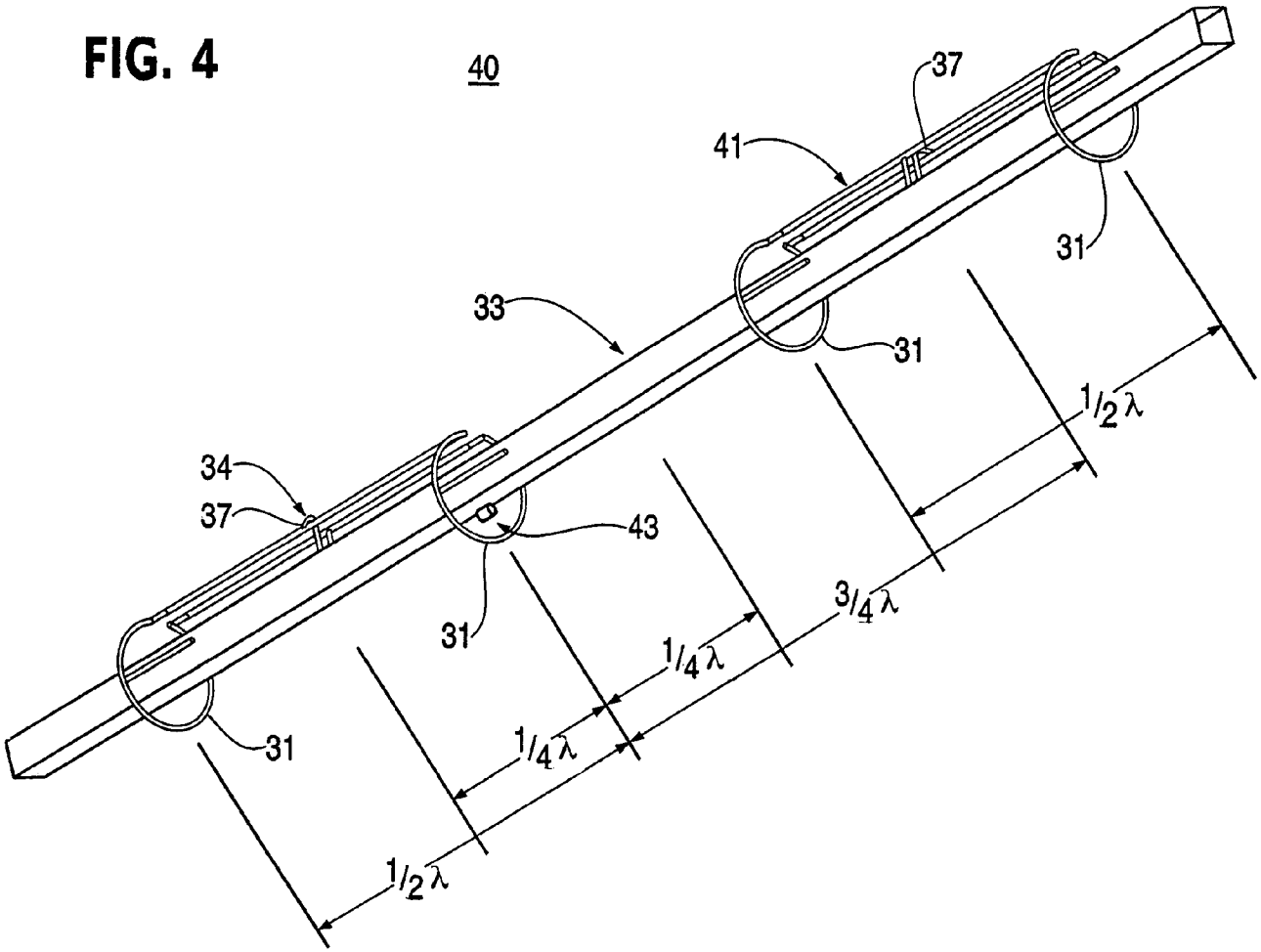
FIG. 4 is a side view of the exemplary antenna of FIG. 3.

FIG. 4 illustrates another perspective view 40 of the exemplary doublet antenna system 30 of this invention. The feed points 34 for the respective stub-loop antenna 31 "upper" and "lower" doublets connect each pair of stub-loop antennas 31 ends via a twin feed line 41 that is exterior to the stripline. The twin feed line 41 for the "upper" doublet is reversed in "polarity" as compared to the "lower" doublet, as evidenced by the feed arm's 37 orientation. That is, the inner conductor of the stripline 33 for the "upper" doublet is coupled to the opposite end of the stub-loop antennas 31 of the "lower" doublet. Similarly, the outer conductor of the stripline 33 is coupled to opposite ends of the stub-loop antennas 31 of the respective doublet pairs. At the "rear end" of the stripline 33, an input connector, illustrated here as a four-layer DIN type, for example, facilitates coupling to a transmission line (not shown) to feed the exemplary antenna doublet system 30. The input connector is co-located with an innermost stub-loop antenna 31, for phasing purposes as discussed below.

Figure 5:
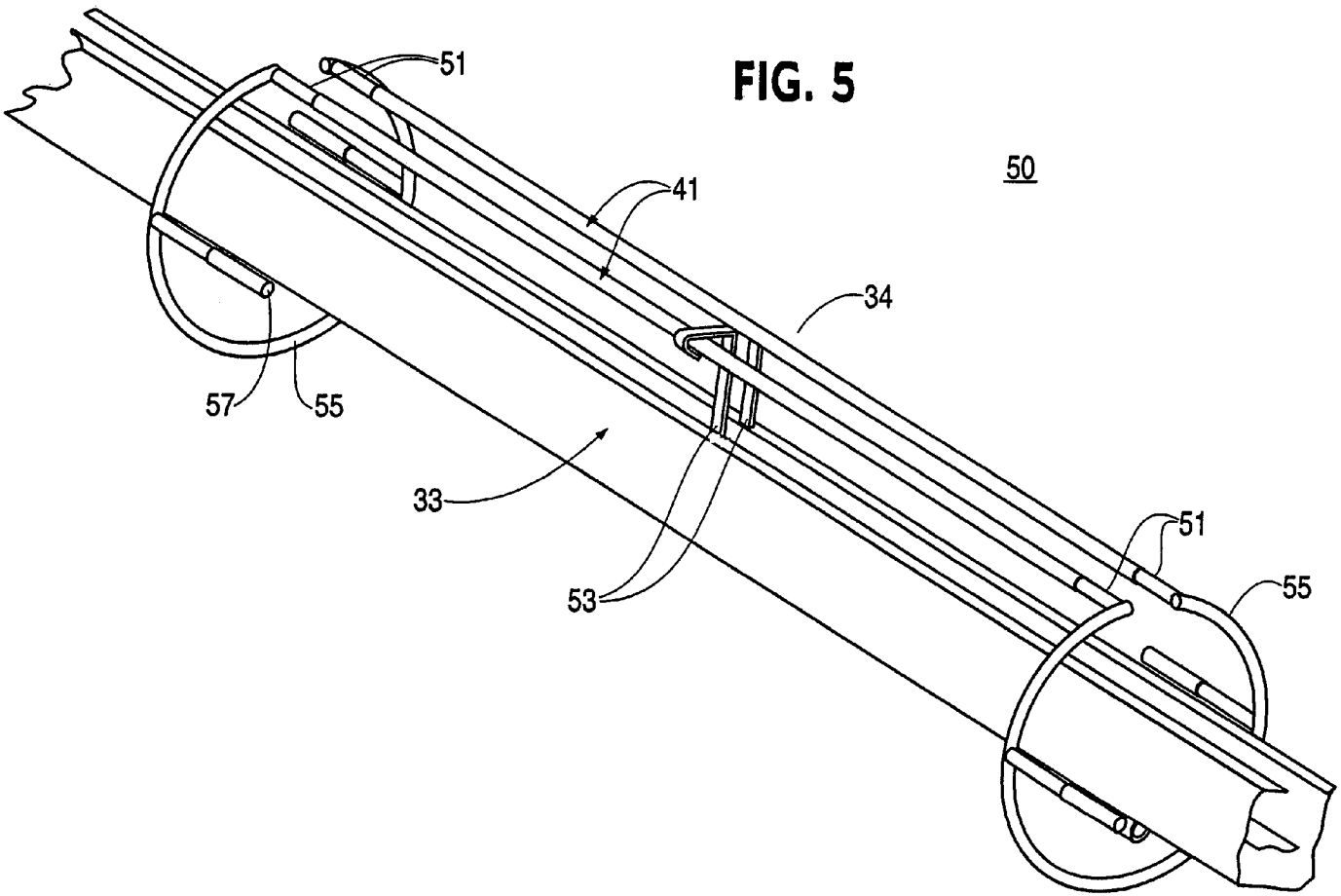
FIG. 5 is a close-up view of the exemplary antenna of FIG. 3.

FIG. 5 illustrates a close-up view 50 of an exemplary stub-loop antenna doublet system according to this invention. The individual stub-loop antennas 55 within a doublet are approximately ½ wavelength separated from each other and are nearly equidistant to the feed point 34, and are coupled to the stripline 33 via the feed lines 41 and the coupling arms 53. The feed lines 41 also provide a supporting structure for supporting the doublet of stub-loop antennas 55. The separation between antennas within a doublet can be adjusted by the slidably adjustable sleeve arrangement 51 to provide phasing and/or frequency adjustments. The sleeve arrangement 51 may operate using frictional locks or any other mechanism that facilitates the desired adjustable operation.

Figure 6:
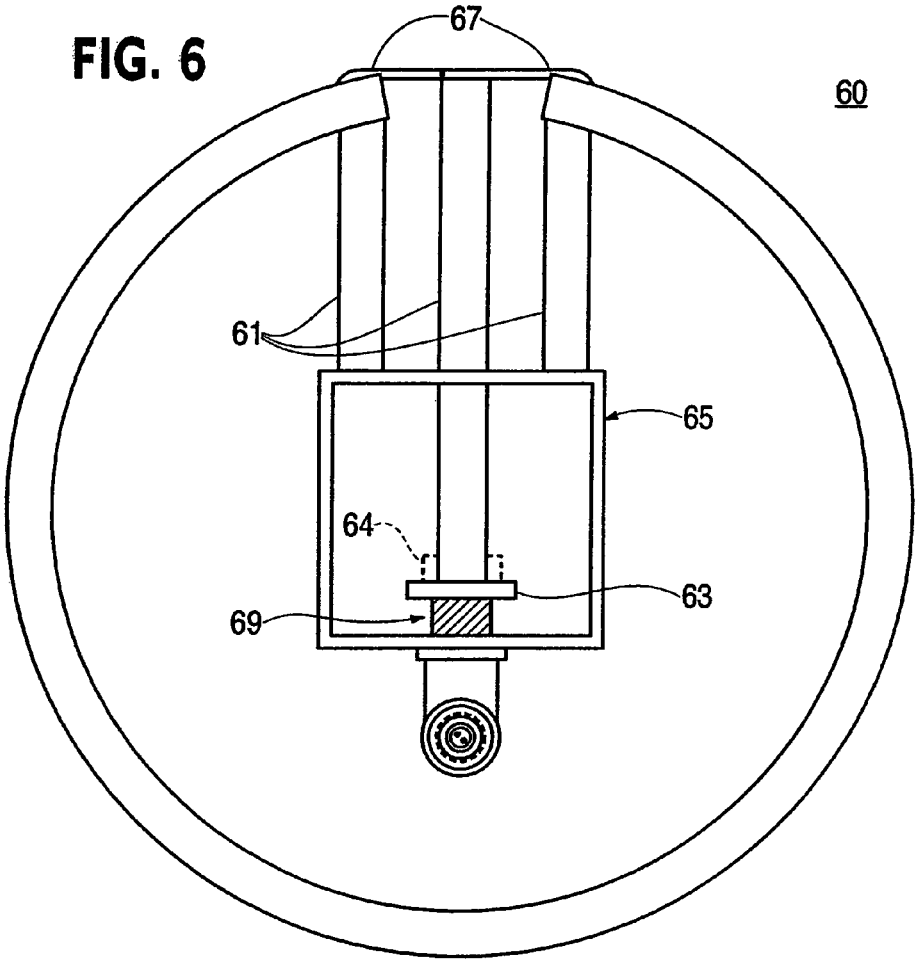
FIG. 6 is a cross-sectional end view of the exemplary antenna of FIG. 3.

FIG. 6 illustrates a cross-sectional view 60 of an end of the exemplary stub-loop antenna system. Coupling arms 61 are illustrated as connecting the stripline inner conductor 63 and the stripline outer conductor 65 via feedlines 41 (obstructed from view) to the ends 67 of the stub-loop radiator.

A matched termination or a short 69 is placed at the end of the stripline inner conductor 63 to terminate the stripline. A connector 43 is coupled to the stripline inner conductor 63 and outer conductor 65 to supply the signals for the antenna doublet system. Any suitable connector or coupler may be used to couple energy into the exemplary antenna system, according to design preferences. The connector 43 is located at approximately ¼ wavelength from the middle of the stripline 33, which is where the first stub-loop antenna of a doublet pair is located. The offset location of the connector 43 provides a ¼ wavelength rotation about the Smith chart, to bring the input impedance of the stub-loop radiators to approximately 100 Ohms. Since the stub-loop radiators are connected in parallel, the overall input impedance will be approximately 50 Ohms.

A tuning disc 64 (illustrated with dashed lines) may optionally be placed on the stripline's inner conductor 63 to provide impedance loading of the stripline 33. Based on the type of tuning disc 64 and its location on the stripline's inner conductor 63, the impedance of the stub-loop antennas either individually or corporately may be adjusted, as desired. Of course, non-disc like tuning devices may be used, as according to design preference. It should be appreciated that alternative forms of altering the impedance of the stub-loop antennas may be accomplished by loading the coupling arms 61 or the feed lines 41 (or adjusting their respective spacing or lengths or diameter). Accordingly, while FIGS. 3–6 illustrate the exemplary embodiments of this invention as having uniform feedlines 41 and a uniform stripline inner conductor 63 and outer conductor 65 geometry, alternative structures that are non-uniform may be used to provide increased impedance or frequency management.

In operation, the exemplary stub-loop antenna doublet system of this invention enables control of the H/V polarization ratio via adjustment separation of the doublet pairs from each other and from the input connector 43. Thus, two degrees of freedom are offered—the ability to reduce or lengthen the distances of the stub-loop antennas from their respective feed point 34 and the input connector 43.

Furthermore, an arraying effect is produced by reverse phasing the feed point 34 for the doublet pairs and with an offset input connector 43 as explained below. In operation, from the offset input connector 43, the input signal has to travel ¼ wavelength on the stripline 33 to the feed point 34 and then ¼ wavelength in opposite directions on the feed lines 41 to the individual stub-loop antennas 31. Thus, the individual stub-loop antennas of the "nearest" doublet to the input connector 43 will experience a net ½ wavelength phase delay from the signal input at the input connector 43, compared to the farthest doublet pair.

Similarly, for the "farthest" doublet antennas, the input signal will be ½ wavelength out of phase with the "nearest" doublet antennas. However, since the coupling arms 53 are reversed, the net phase delay will be equalized. Consequently, both the "nearest" and "farthest" pairs of doublets from the input connector 43 can be driven in phase and can be accordingly manipulated as a vertical array of radiators. Additionally, phasing control can also be obtained by enabling the input connector's 43 position on the stripline to be adjustable.

Due to this location of the input connector 43 with respect to the doublet pairs and the adjustable length vertical dipoles, a stub-loop antenna array is formed whose horizontal versus vertical polarization power and patterns can be tuned. Moreover, by use of common tuning elements, such as a tuning disc on the stripline 33, the input impedance of the stub-loop antenna doublets can be adjusted without adversely affecting the polarization or pattern characteristics. Furthermore, due to the simple configuration provided herein, exemplary embodiments of this invention can be simply assembled and tuned to the desired performance requirements without excessive tuning procedures. For example, the adjustable sleeves 51 shown in FIG. 5 may incorporate markings that indicate which locations/distances to adjust the stub-loop antennas for a desired performance or frequency. Similarly, the vertical dipoles 57 may also incorporate markings to facilitate the same.

It should be appreciated that alternative designs using different stub-loop antenna types such as square loops and/or folded dipoles, for example, may be used without departing from the spirit and scope of this invention. Furthermore, while the various exemplary embodiments of this invention illustrate an air-stripline with a rectangular casing, other forms of striplines or energy conveying transmission lines may be used such as a coaxial slotted line, or a waveguide. Additionally, the input connector location is understood not to be restricted to only one type or location, but may be moved or placed at alternate locations on the stripline, to facilitate tuning or phase reversal, for example.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A circularly polarized antenna array, comprising:

a feed assembly having an outer conductor partially encompassing an inner conductor wherein the outer conductor and the inner conductor are substantially parallel;

feedlines coupled to and substantially parallel to the inner conductor and the outer conductor and traversing a substantial portion of a length of the feed assembly;

a plurality of stub-loop antennas coaxially disposed about the feed assembly, coupled to the feed lines and positioned approximately one-half wavelength from a neighboring stub-loop antenna; and a feed point for the feed assembly, positioned approximately one-quarter wavelength from a midpoint of the feed assembly and approximately coincident to a first stub-loop antenna, wherein a first pair of the plurality of the stub-loop antennas are fed in opposite phase with respect to a second pair of the plurality of stub-loop antennas.

2. The antenna array according to claim 1, wherein the stub-loop antennas of the first pair are driven in phase and the stub-loop antennas of the second pair are driven in phase.

3. The antenna array according to claim 1, wherein the stub-loop antennas have dipole arms that are adjustable in length.

4. The antenna array according to claim 1, wherein the stub-loop antennas are supported by the feedlines.

5. The antenna array according to claim 1, wherein the portion of the stub-loop antennas on the feed assembly is adjustable.

6. The antenna array according to claim 5, wherein the stub-loop antennas' position on the feed assembly is slidably adjustable.

7. The antenna array according to claim 1, further comprising:

at least one or more tuning elements disposed on the inner conductor.

8. The antenna array according to claim 1, wherein the feed point is adjustably positionable on the feed assembly.

9. The antenna array according to claim 1, wherein the feed assembly is approximately 1.5 wavelength in length.

10. The antenna array according to claim 1, wherein ends of the inner conductor are shorted.

11. The antenna array according to claim 1, wherein the feed assembly is a stripline with a slotted grounding structure.

12. The antenna array according to claim 1, wherein the feed assembly is a coaxial line with a slotted outer conductor.

13. A circularly polarized antenna array, comprising:

a plurality of radiating means for radiating vertically polarized electromagnetic radiation and horizontally polarized electromagnetic radiation wherein the portion of the radiating means for radiating vertically polarized radiation is adjustable in length;

feeding means for feeding energy to the radiating means;

transmission line means for transmitting energy to the feeding means; and means for coupling the transmission line means to the feeding means, wherein the coupling means is positioned approximately one-quarter wavelength from a mid-point of the transmission line means, wherein a first pair of the plurality of radiating means are fed in opposite phase with respect to a second pair of the plurality of radiating means.

14. The antenna array according to claim 13, further comprising:

turning means for tuning the impedance of the radiating means.

15. The antenna array according to claim 13, wherein the radiating means are supported by the feeding means.

16. The antenna array according to claim 13, wherein the position of the radiating means on the transmission line is adjustable.

17. The antenna array according to claim 13, wherein the first pair of the radiating means are driven in phase and the second pair of radiating means are driven in phase.

18. The antenna array according to claim 13, wherein coupling means is adjustably positionable on the transmission line means.

19. The antenna array according to claim 13, wherein the transmission means is end-terminated.

20. A method for generating circularly polarized electromagnetic signals, comprising the steps of:

positioning a first pair of circularly polarized antennas and a second pair of circularly polarized antennas approximately one wavelength from pair center, wherein a first antenna of a pair is approximately one quarter wavelength from a second antenna of the pair;

feeding a broadcast signal to the first and second pairs of antennas using oppositely-phased feed points and a feed line directly coupled to the pairs of antennas;

inputting the broadcast signal to a transmission line coupled to the feed line at a point coincident to an antenna and approximately one-quarter wavelength from a mid-point of the transmission line; and adjusting the positions of the first pair and second pair of antennas.

21. The method according to claim 20, further comprising:

tuning an impedance of the antennas by use of a tuning element on the transmission line.

* * * * *